US008074994B1

(12) United States Patent
Delphia

(10) Patent No.: US 8,074,994 B1
(45) Date of Patent: Dec. 13, 2011

(54) TREE STAND ARCHERY TARGET SYSTEM

(75) Inventor: Richard A Delphia, Waterbury, VT (US)

(73) Assignee: The Partnership of Richard A. Delphia and Donald G. Clark, Waterbury, VT (US)

( * ) Notice: Subject to any disclaimer, the term of this patent is extended or adjusted under 35 U.S.C. 154(b) by 0 days.

(21) Appl. No.: 12/191,880

(22) Filed: Aug. 14, 2008

Related U.S. Application Data

(60) Provisional application No. 60/955,885, filed on Aug. 15, 2007.

(51) Int. Cl.
*F41J 7/02* (2006.01)

(52) U.S. Cl. ..... 273/406; 211/119.02; 211/119.16; 212/94

(58) Field of Classification Search ..... 273/359, 273/366–370, 403–410; 211/119.01–119.18; 212/71–123
See application file for complete search history.

(56) References Cited

U.S. PATENT DOCUMENTS

| | | | | | |
|---|---|---|---|---|---|
| 881,784 | A * | 3/1908 | Fitts | 211/94.03 |
| 1,727,272 | A * | 9/1929 | Caswell | 273/406 |
| 2,344,829 | A * | 3/1944 | Mcavoy | 104/173.1 |
| 2,586,958 | A | 2/1952 | Keller | |
| 2,793,038 | A * | 5/1957 | Wallace et al. | 273/369 |
| 2,838,309 | A * | 6/1958 | Merz et al. | 273/406 |
| 3,020,047 | A * | 2/1962 | Spieth | 273/406 |
| 3,306,616 | A | 2/1967 | Baldwin | |
| 3,363,900 | A * | 1/1968 | Cadle | 273/359 |
| 3,471,153 | A * | 10/1969 | Baumler | 273/359 |
| 4,286,788 | A * | 9/1981 | Simington et al. | 273/359 |
| 4,601,261 | A * | 7/1986 | Genelin | 119/839 |
| 4,645,210 | A * | 2/1987 | Patsy | 473/446 |
| 4,890,847 | A * | 1/1990 | Cartee et al. | 273/406 |
| 7,614,626 | B1 * | 11/2009 | Aanerud et al. | 273/367 |
| 2008/0088089 | A1 * | 4/2008 | Bliehall et al. | 273/359 |

* cited by examiner

*Primary Examiner* — Mark Graham
(74) *Attorney, Agent, or Firm* — James Marc Leas

(57) ABSTRACT

A system includes a first cable support, a second cable support, a first cable and a second cable. The first cable is moveably mounted between the first cable support and the second cable support. The system also includes a supporting structure supported by the first cable and by the second cable, wherein the supporting structure is connected to the first moveable cable to move with the first moveable cable.

21 Claims, 8 Drawing Sheets

TREE STAND ARCHERY TARGET SYSTEM

RELATED APPLICATIONS

This application claims the benefit of provisional patent application 60/955,885 filed Aug. 15, 2007, incorporated herein by reference.

FIELD

This patent application generally relates to an archery target system. More particularly, it relates to a system that retrieves arrows shot at a target. Even more particularly, it relates to a system that retrieves arrows shot at a target from a tree stand without the archer having to leave the tree stand.

BACKGROUND

An archery range with a moveable target that enables an archer to retrieve arrows was disclosed in U.S. Pat. No. 2,586,958 to Keller. The targets are moved along tracks by a cable.

An enclosed archery lane having a movable target was disclosed in U.S. Pat. No. 3,306,616 to Baldwin. When it is desired to retrieve the arrows they may bring the target to the vicinity of the bow and bring with it the spent arrows that may not have lodged in the target or its backstop.

However, neither of these systems is suitable for use in a tree stand archery target system. Thus a better scheme is needed for retrieving arrows, and these improvements are provided in this patent application.

SUMMARY

One aspect of the present patent application is a system that includes a first cable support, a second cable support, a first moveable cable, a second cable, and a target. The first moveable cable is moveably mounted between the first cable support and the second cable support. The second cable is horizontally displaced with respect to the first cable. The system also includes a supporting structure supported by the first moveable cable and the second cable. The supporting structure is connected to the first moveable cable to move with the first moveable cable. The target hangs from the supporting structure.

The system also includes a target, wherein the supporting structure supports the target. In one embodiment the target includes an archery target. The supporting structure includes a support bar, wherein the target is mounted to the support bar with eye hooks, string, chain, cable, or S hooks. The first cable support includes a first pulley and the second cable support includes a second pulley.

The first cable support includes components for mounting the first cable support to a tree and the second cable support includes components for mounting the second cable support to the ground. In one embodiment the first components include cleats. In another they include a strap. The second components include a stake.

In one embodiment the first cable is moved manually. In another embodiment, the first cable is moved by a motor connected to the first pulley.

The first cable has its first end and its second end connected to the supporting structure.

The second cable is immovable and the supporting structure moves along the immovable second cable. A roller is mounted to the supporting structure and to the second cable, wherein the supporting structure rolls along the second cable when the first cable is moved.

An alignment arm maintains alignment of the supporting structure with respect to the first cable and the second cable when the first cable is moved.

Another aspect is a method of archery target practice to a target on the ground from a platform in a tree, that includes providing first and second cable supports mounted to the tree elevated above the ground. The method also includes providing third and fourth cable supports mounted on the ground. It also includes providing a first cable moveably mounted so a point on the first cable can move between the first and third cable supports. The method also includes providing a second cable mounted between the second and fourth cable supports, wherein the second cable is mounted substantially parallel to the first cable. It also includes supporting an archery target with the first cable and the second cable. And it includes moving the first cable to move the archery target from a location near the third and fourth cable supports to a location near the first and second cable supports.

BRIEF DESCRIPTION OF THE DRAWINGS

The foregoing will be apparent from the following detailed description, as illustrated in the accompanying drawings, in which:

FIG. 5*a*' is a three dimensional view showing an alternate embodiment of the tree support portion of the system of FIG. 5*a* but with a battery operated motor;

DETAILED DESCRIPTION

The present application provides apparatus for an archer to retrieve arrows shot at a target from a tree stand without the archer having to leave the tree stand.

Figure 1:
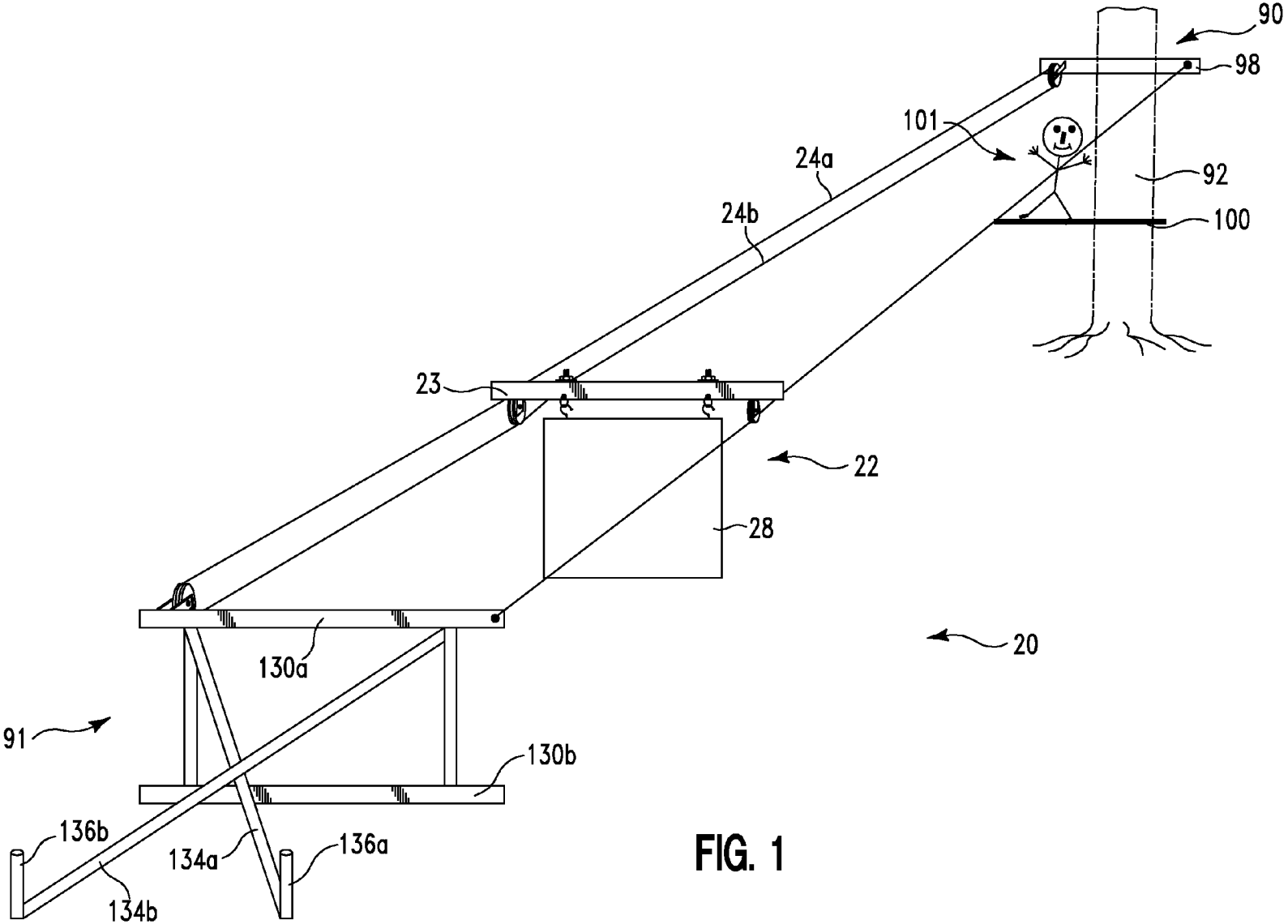
FIG. 1 is a three dimensional view of the system of the present patent application.
Figure 2:
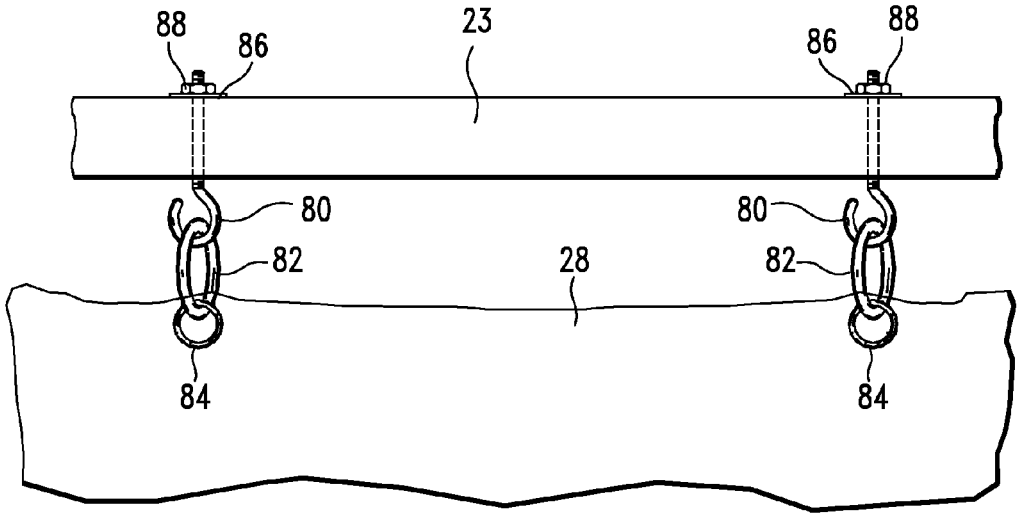
FIG. 2 is a front view of the target and the target support.
Figure 4A:
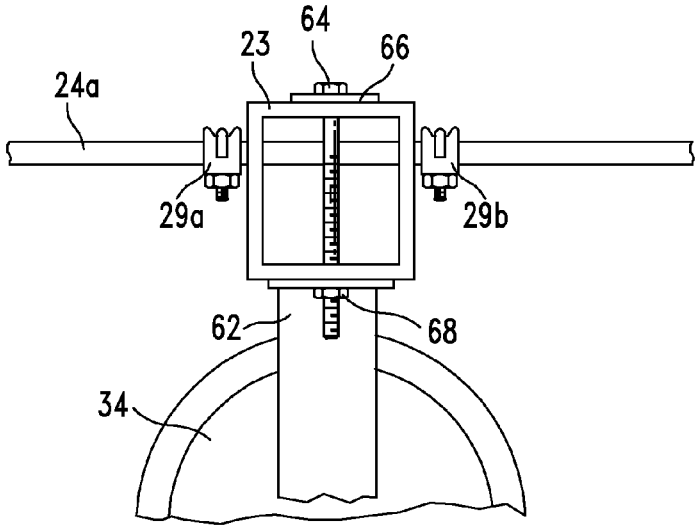
FIG. 4*a* is a side view showing how the target support bar is connected to one portion of the moveable cable with cable clamps and has a pulley that rolls along an adjacent portion of the moveable cable.
Figure 4C:
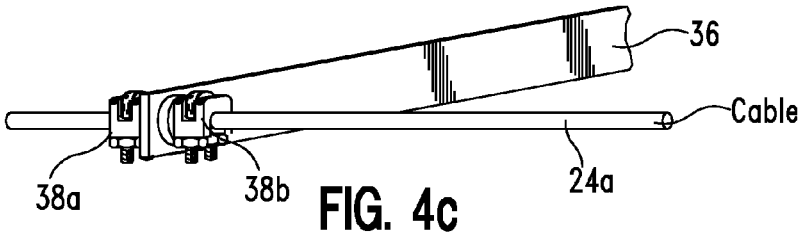
FIG. 4*c* is a three dimensional view showing the alignment arm connection to the moveable cable.
Figure 3:
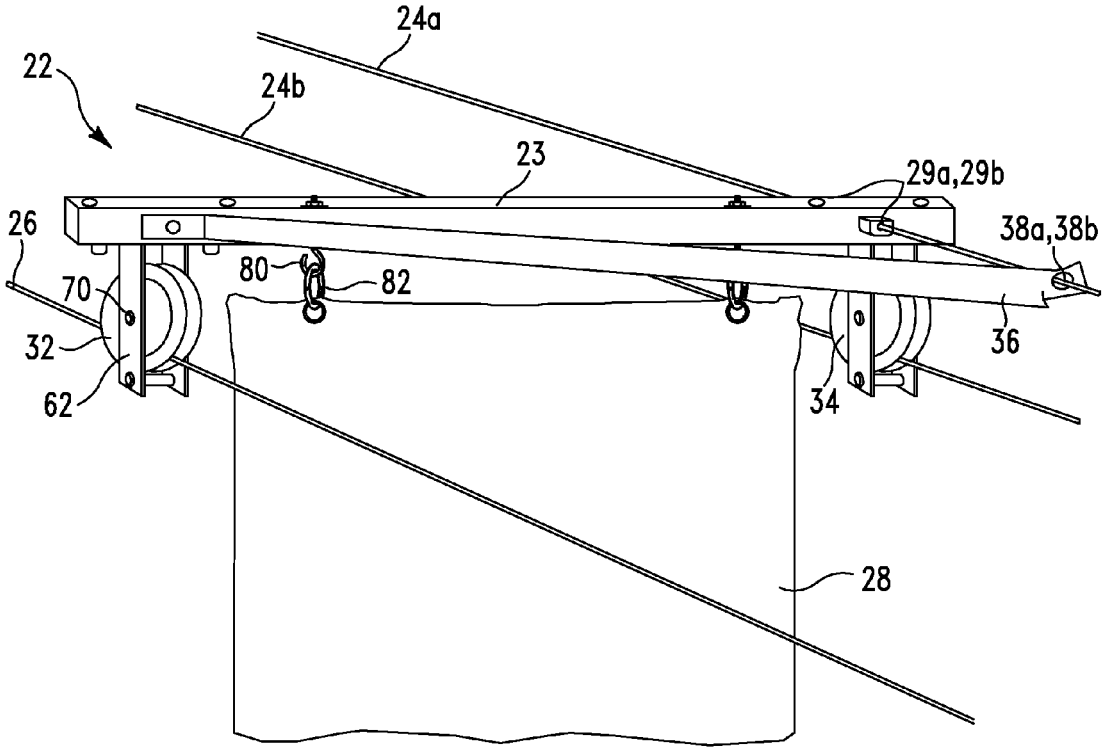
FIG. 3 is a three dimensional view showing the target support bar supporting the target, the connections of the target support bar to the moveable cable and to the fixed cable and connections of an alignment arm extending from the support bar to the moveable cable.
Figure 4B:
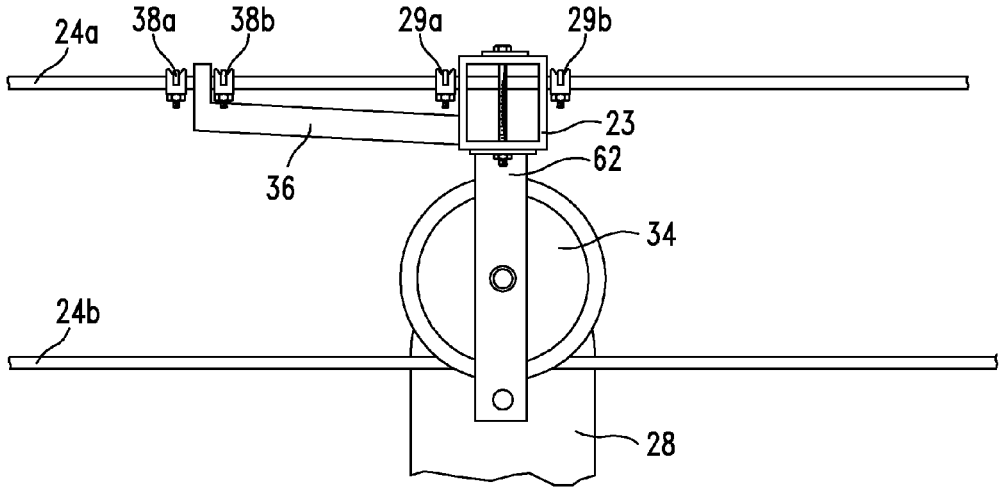
FIG. 4*b* is a side view showing an alignment arm extending from the target support bar to the moveable cable.

Tree stand archery system 20 includes target supporting structure 22 supported by moveable cable 24*a*, 24*b* and stationary cable 26, as shown in FIG. 1. Stationary cable 26 is mounted substantially parallel to moveable cable 24*a*, 24*b*. Target supporting structure 22 includes support bar 23 that supports target support 28, as shown in FIGS. 1-3. Support bar 23 is attached to moveable cable 24*a* with bolted cable clamps, 29*a*, 29*b* and moves with moveable cable 24*a*, as shown in FIGS. 3 and 4*a*, 4*b*. Target supporting structure 22 includes pulley 32 that rolls along stationary cable 26 while support bar 23 moves with moveable cable 24*a*. Target supporting structure 22 also includes pulley 34 that rolls along moveable cable 24*b* while support bar 23 moves with moveable cable 24*a*. Thus, support bar 23 receives support from stationary cable 26 and from both moveable cable 24*a* and from moveable cable 24*b*. Weight of support bar 23 is fully supported by said moveable cable 24*a*, 24*b* and by stationary cable 26. Separation between moveable cables 24*a* and 24*b* is maintained by use of pulley 24. Cables 24*a*, 24*b* and 26 are fabricated of a material such as plastic coated steel. It can also be fabricated of rope, string, or plastic. The cable can have a diameter of 3/16 inch and can range from 1/8 inch to 3/8 inch. Pulleys 32, 34 are fabricated of a material such as aluminum, steel, or plastic and have a diameter in the range of 3 to 4 inches.

In one embodiment target supporting structure 22 supports target support 28 between first moveable cable 24*a*, 24*b* and stationary cable 26, as shown in FIG. 1. In one embodiment, target supporting structure 22 has a first support location and a second support location. The second support location is horizontally displaced with respect to the first support location. The first support location is supported by moveable cable 24*a*, 24*b* and the second support location is supported by stationary cable 26. Target support 28 has a width. Cable 26 is horizontally displaced with respect to moveable cable 24*a*, 24*b* by an amount greater than this width. In one embodiment, target support 28 hangs from support bar 23 entirely between first moveable cable 24*a*, 24*b* and stationary cable 26. In one embodiment, target support 28 includes a central region, and no cable extends over the central region.

In one embodiment, target supporting structure 22 includes a third location and a fourth location, as shown in FIG. 1. Target supporting structure 22 supports target support 28 at the third location and at the fourth location. The fourth location is horizontally displaced with respect to the third location.

Target supporting structure 22 also includes alignment arm 36 that extends from support bar 23 to moveable cable 24*a*. Alignment arm 36 is connected to moveable cable 24*a* with bolted cable clamps 38*a*, 38*b*, as shown in FIG. 4*c*, so that alignment arm 36 moves with moveable cable 24*a* and so that a fixed distance is maintained between the attachment of support bar 23 to moveable cable 24*a* and bolted cable clamps 38*a*, 38*b* of alignment arm 36. Alignment arm 36 maintains pulley 32 parallel with pulley 34 while support bar 23 is being pulled on one side by movement of cable 24*a*. Thus, relative displacement of pulley 34 with respect to pulley 32 is avoided that could cause binding.

Figure 4D:
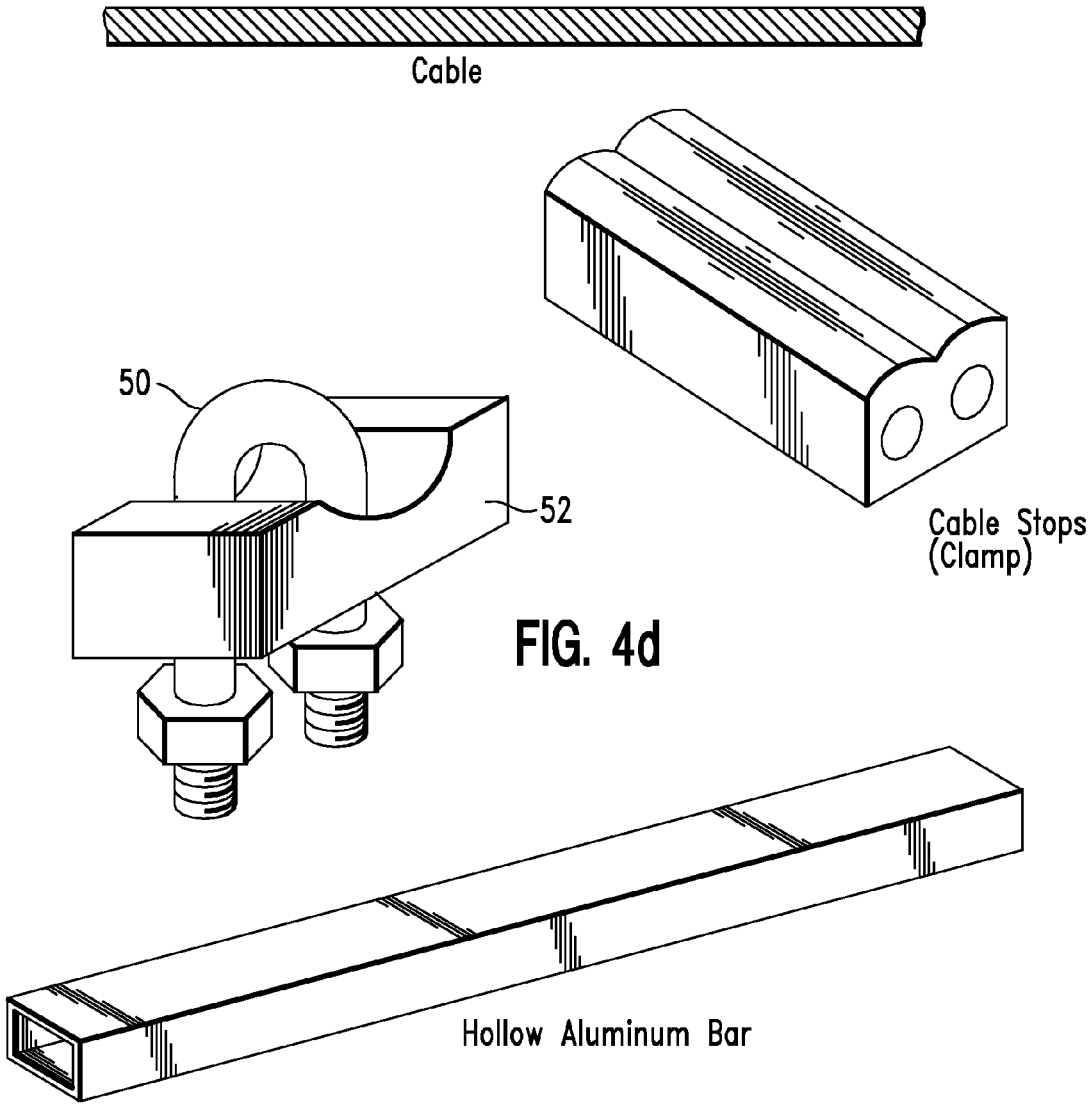
FIG. 4*d* is a three dimensional view showing a bolted cable clamp similar to those used for connecting the target support bar to the moveable cable.

Bolted cable clamps 29*a*, 29*b*, 38*a*, 38*b* each include U bolt 50 and base 52, as shown in FIG. 4*d*.

Figure 4E:
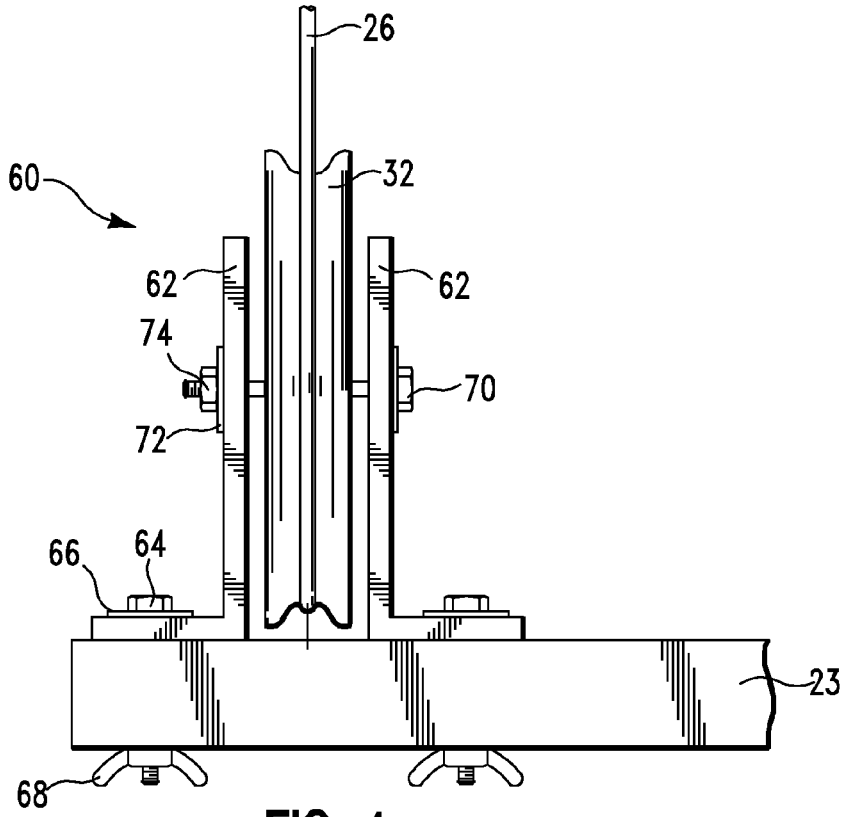
FIGS. 4*e* and 4*f* are alternate front views showing a pulley for mounting to the target support bar and to the fixed cable.
Figure 4F:
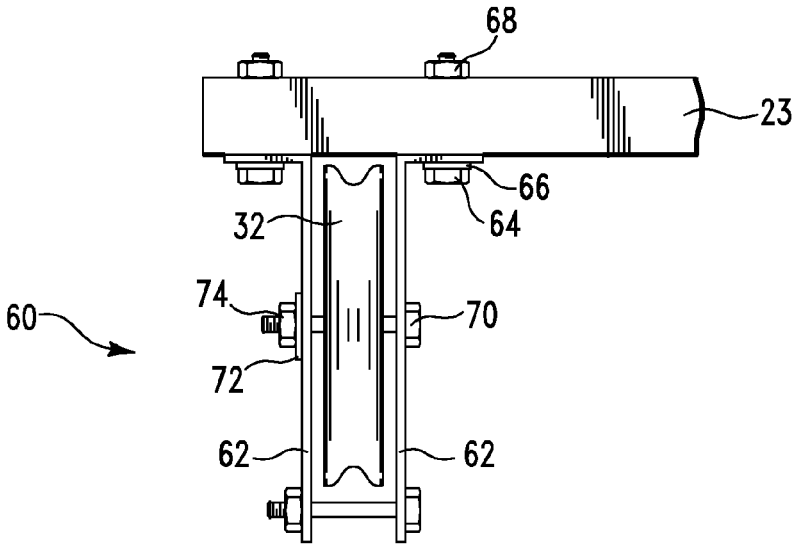

Pulleys 32, 34 are each part of pulley assemblies 60 that includes L-shaped pulley mounts 62 that fasten to support bar 23 with bolt 64, washer 66, and wing nut 68, as shown in detail in FIGS. 4*e*, 4*f*. Pulley 32, 34 is connected to L-shaped pulley mount 62 with bolt 70, washer 72, and nut 74, as shown in FIG. 3. Dual pulley mounts 62 are shown in FIG. 3 and in FIGS. 4*e*, 4*f* to provide greater support for pulleys 32, 34.

Target support 28 is suspended from support bar 23 with eye hooks 80 and carbiners 82, as shown in FIGS. 2 and 3. Carbiners 82 extend through holes 84 in target support 28. Eye hooks 80 extend through support bar 23 and are held in position with washers 86 and nuts 88. Target support 28 may also be suspended from support bar 23 with string, chain, cable, or S hooks. Archery target 89 (FIG. 1) may be attached to target support 28.

In one embodiment target support 28 is a 24" by 24" bag target for use with field point arrows. In another embodiment, target support 28 is a foam target for use with broad head arrows. 3-D targets and cube targets can also be used.

Figure 5A:
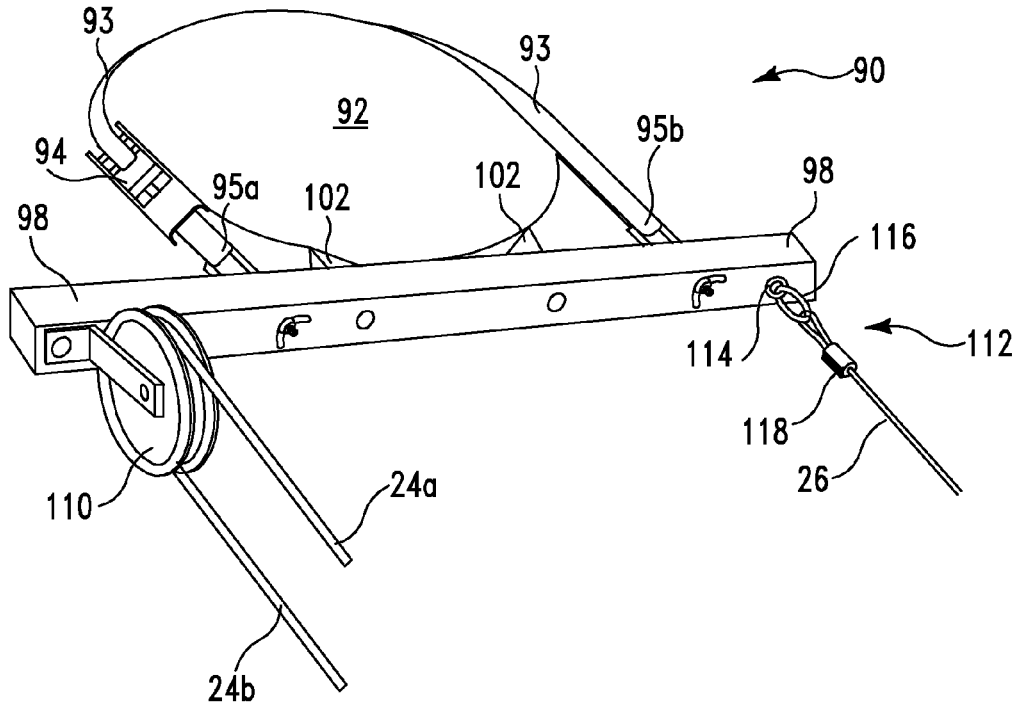
FIG. 5*a* is a three dimensional view showing the tree support portion of the system of the present patent application, including a support bar for holding ends of the moveable and fixed cables, a ratchet strap for mounting to a tree, tree support clamps, and a pulley for moving the moveable cable.
Figure 5B:
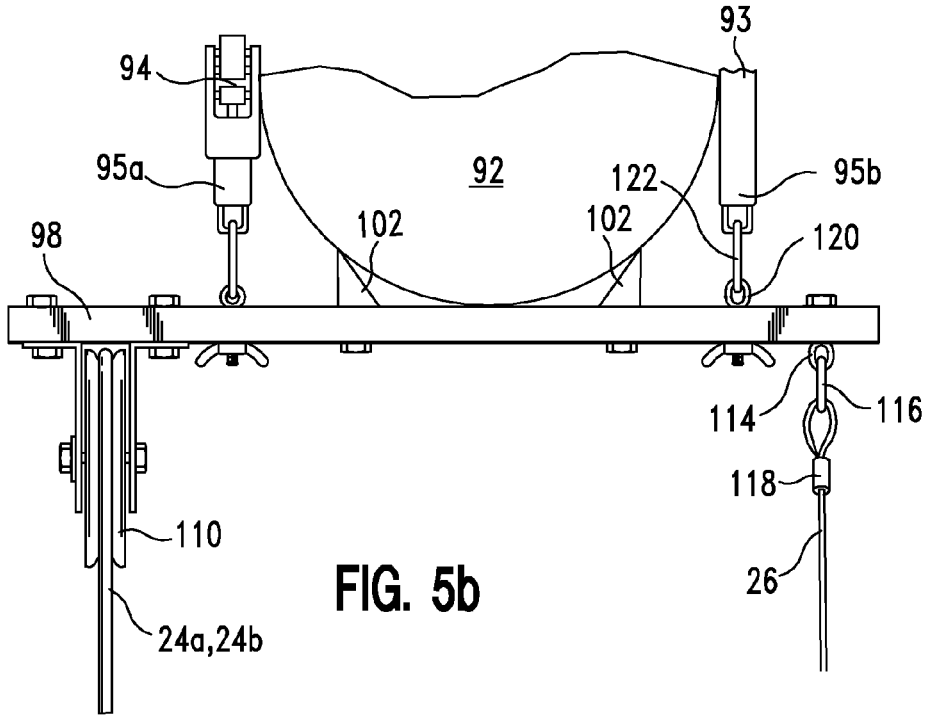
FIG. 5*b*' is a top view showing the tree support portion of the system of FIG. 5*a*'.
Figure 5A:
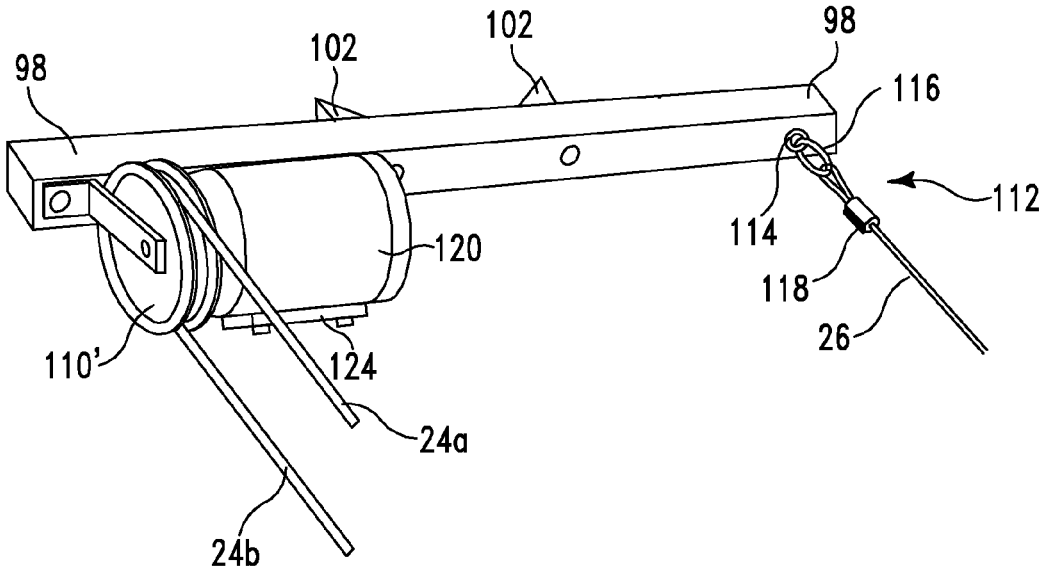
Figure 5B:
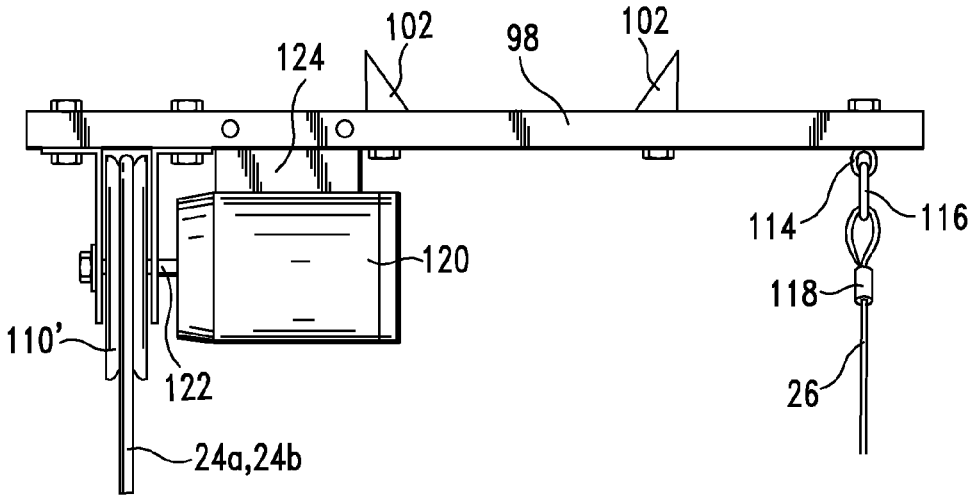
Figure 6A:
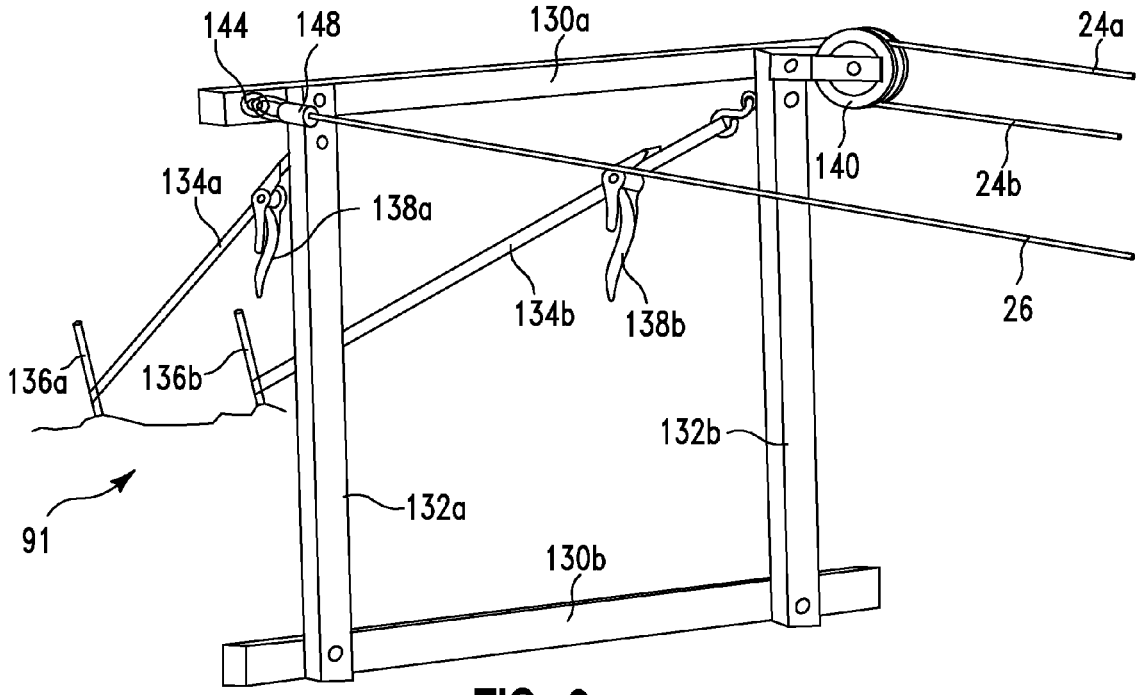
FIG. 6*a* is a three dimensional view of the ground support portion of the system of FIG. 1.
Figure 6B:
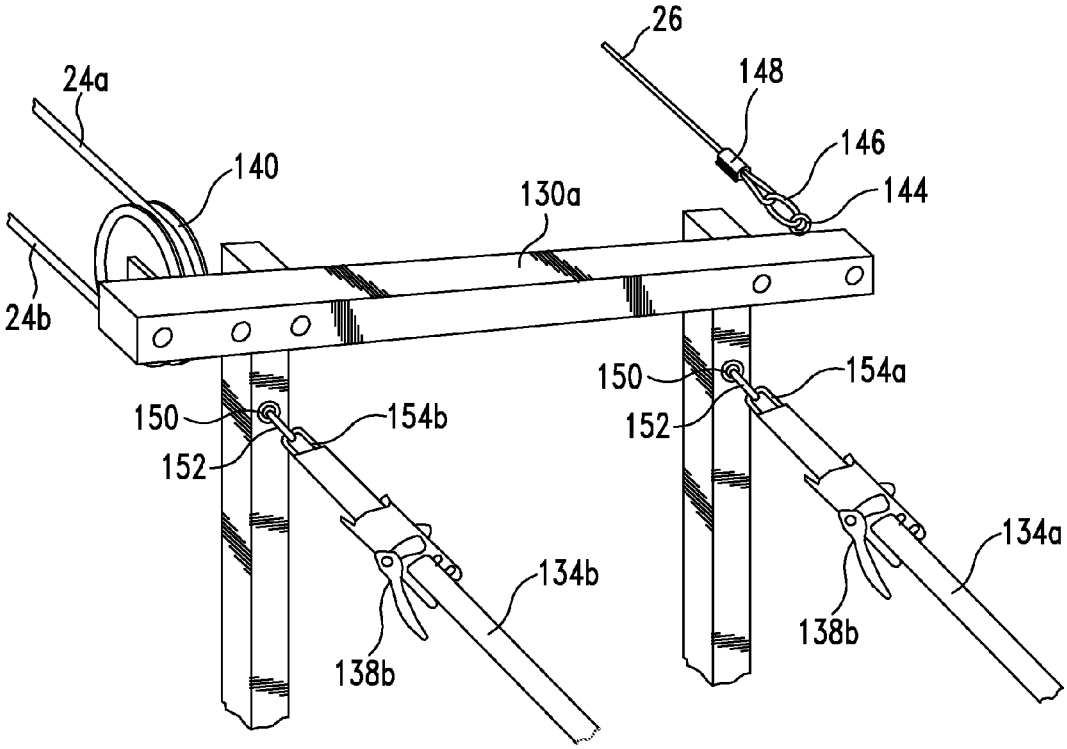
FIG. 6*b* is another three dimensional view of the ground support portion of the system of FIG. 1.

Cables 24*a*, 24*b* and 26 are supported at one end by tree support structure 90, as shown in FIGS. 1 and 5*a*, 5*b* and at the other end by ground support structure 91, as shown in FIGS. 1 and 6*a*, 6*b*.

Tree support structure 90 is attached to tree 92 with ratchet strap 93 that wraps around tree 92, that includes ratchet 94 and connects at each end 95*a*, 95*b* to tree support bar 98, as shown in FIGS. 5*a*, 5*b*. Tree support structure 90 may be attached to tree 92 at an elevation in the range from about 8 feet to about 30 feet above the ground and above platform 100 that archer 101 may stand on while using tree stand archery system 20. Archer 101 can control the position of target support 28 by controlling the position of cable 24*a*, 24*b*. Tree support cleats 102 extend from tree support bar 98 into tree 92 to further support tree support bar 98 and to prevent tree support structure 90 from slipping down tree 92.

Ratchet strap 93 has a strap dimension of 1 inch. Rope, cable, and pull strap can also be used.

Tree support structure 90 includes pulley 110 that supports cables 24*a*, 24*b*. Tree support structure 90 also includes mounting 112, including eye hook 114, carbiner 116, and cable clamp 118 at tree end of stationary cable 26.

Tree support structure 90 also includes eye hooks 120 and carbiners 122 for connecting ends 95*a*, 95*b* of ratchet strap 93 to tree support bar 98.

Cable 24*a*, 24*b* may be moved by hand to move target support 28, as shown in FIGS. 1 and 5*a*, 5*b*. Cable 24*a*, 24*b* may also be moved with motor 120 connected to turn axle 122 of pulley 110', as shown in FIGS. 5*a*', 5*b*'. Motor 120 is mounted to support bar 98 with motor mount 124. Motor 120 is operated with electric power supplied by a battery. Electric power can also be supplied from solar power.

Ground support structure 91 includes horizontal support bars 130*a*, 130*b* and vertical support bars 132*a*, 132*b*, as shown in FIGS. 6*a*, 6*b*. Ratchet straps 134*a*, 134*b* extend from vertical supports 132*a*, 132*b* and are held in place with meal stakes 136*a*, 136*b* driven into the ground. Ratchets 138*a*, 138*b* are use to provide tension holding horizontal support bar 130*a* in position. Support bars are fabricated of a material such as aluminum, white metal, steel, or wood. A prototype of the entire system was fabricated and tested using aluminum support bars made of square stock tubing 1/8 inch thick.

Ratchet straps 134*a*, 134*b* have strap dimensions of 2 inches. Rope, cable, and pull strap can also be used. Metal stakes 136*a*, 136*b* have dimensions of 3 inches.

Horizontal support bar 130*a* includes pulley 140 that supports cables 24*a*, 24*b*. Horizontal support 130*a* also includes mounting 142, including eye hook 144, carbiner 146, and cable clamp 148 at ground support end of stationary cable 26.

Horizontal support bar 130*a* also includes eye hooks 150 and carbiners 152 for connecting ends 154*a*, 154*b* of ratchet straps 134*a*, 134*b* to horizontal support bar 130*a*.

Pulleys 32, 34, 110, and 140 are ball bearing pulleys, and have a size in the range from 1 inch to 12 inches. Bushing and plastic insert pulleys can also be used.

In operation, archer 101, standing on platform 100, moves cables 24*a*, 24*b* to bring target support 22 up to the location of platform 100 in tree 92 so he or she can remove arrows from target 89 on target support 22. Archer 101 then moves cables 24*a*, 24*b* to bring target support 22 down to the location of ground support 91. Archer 101 then shoots arrows. Once archer 101 has shot the arrows he or she again moves cables 24*a*, 24*b* to bring target support 22 up to his or her location. The scheme allows archer 101 to practice shooting from tree platform 100 without having to climb up and down tree 92 to retrieve arrows after they hit target 89.

While several embodiments, together with modifications thereof, have been described in detail herein and illustrated in the accompanying drawings, it will be evident that various further modifications are possible without departing from the scope of the invention as defined in the appended claims. Nothing in the above specification is intended to limit the invention more narrowly than the appended claims. The examples given are intended only to be illustrative rather than exclusive.

The invention claimed is:

1. A system, comprising:

a first cable support and a second cable support;

a first moveable cable moveably mounted between said first cable support and said second cable support;

a second cable, wherein said second cable is horizontally displaced with respect to said first moveable cable;

a supporting structure, wherein weight of said supporting structure is fully supported by said first moveable cable and by said second cable, wherein said supporting structure is connected to said first moveable cable to move with said first moveable cable; and an arrow receiving structure, wherein said arrow receiving structure hangs from said supporting structure between said first moveable cable and said second cable, wherein said arrow receiving structure includes a central region, wherein no cable extends over said central region.

2. A system as recited in claim 1, wherein said supporting structure supports said arrow receiving structure between said first moveable cable and said second cable.

3. A system as recited in claim 1, wherein said arrow receiving structure includes an archery target.

4. A system as recited in claim 1, wherein said supporting structure includes a support bar, wherein said arrow receiving structure is mounted to said support bar with at least one from the group consisting of eye hooks, string, chain, cable, and S hooks.

5. A system as recited in claim 1, further comprising a first pulley and a second pulley, wherein said first cable support includes said first pulley and wherein said second cable support includes said second pulley.

6. A system as recited in claim 5, further comprising first components and second components, wherein said first cable support includes said first components for mounting said first cable support to a tree and wherein said second cable support includes second components for mounting said second cable support to ground.

7. A system as recited in claim 6, wherein said first components include at least one from the group including cleats and a strap.

8. A system as recited in claim 6, wherein said second components include a stake.

9. A system as recited in claim 5, wherein said first cable is moved manually.

10. A system as recited in claim 5, wherein said first cable is moved by a motor connected to said first pulley.

11. A system as recited in claim 5, wherein said first cable has a first end and a second end, wherein said first end is connected to said supporting structure and wherein said second end is connected to said supporting structure.

12. A system as recited in claim 1, wherein said second cable is immovable and wherein said supporting structure moves along said immovable second cable.

13. A system as recited in claim 12, further comprising a roller mounted to said supporting structure and to said second cable, wherein said supporting structure rolls along said second cable when said first cable is moved.

14. A system as recited in claim 13, further comprising an alignment arm for maintaining alignment of said supporting structure with respect to said first cable and said second cable when said first cable is moved.

15. A system as recited in claim 1, wherein said supporting structure has a first support location and a second support location, wherein said second support location is horizontally displaced with respect to said first support location, wherein said first support location is supported by said first cable and wherein said second support location is supported by said second cable.

16. A system as recited in claim 15, wherein said supporting structure includes a third location and a fourth location, wherein said arrow receiving structure hangs from said supporting structure at said third location and at said fourth location, wherein said fourth location is horizontally displaced with respect to said third location.

17. A system as recited in claim 16, wherein said arrow receiving structure includes an archery target.

18. A system as recited in claim 1, wherein said second cable is horizontally displaced with respect to said first moveable cable by an amount greater than width of said arrow receiving structure.

19. A system as recited in claim 1, wherein said arrow receiving structure has an arrow receiving structure width, wherein said second cable is horizontally displaced with respect to said first moveable cable by an amount greater than said arrow receiving structure width.

20. A system as recited in claim 1, wherein said arrow receiving structure hangs from said supporting structure entirely between said first moveable cable and said second cable.

21. A system, comprising:

a first cable support and a second cable support;

a first moveable cable moveably mounted between said first cable support and said second cable support;

a second cable, wherein said second cable is horizontally displaced with respect to said first moveable cable;

a supporting structure, wherein weight of said supporting structure is fully supported by said first moveable cable and by said second cable, wherein said supporting structure is connected to said first moveable cable to move with said first moveable cable; and an arrow receiving structure wherein said arrow receiving structure hangs from said supporting structure, wherein said arrow receiving structure has an arrow receiving structure width, wherein said second cable is horizontally displaced with respect to said first moveable cable by an amount greater than said arrow receiving structure width.

* * * * *